US008800661B2

(12) United States Patent
Madero et al.

(10) Patent No.: US 8,800,661 B2
(45) Date of Patent: Aug. 12, 2014

(54) DUAL INLINE SLIDING SLEEVE VALVE

(75) Inventors: Paul Madero, Cypress, TX (US); James G. King, Kingwood, TX (US); Jack D. Farmer, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 322 days.

(21) Appl. No.: 13/345,302

(22) Filed: Jan. 6, 2012

(65) Prior Publication Data

US 2013/0175040 A1 Jul. 11, 2013

(51) Int. Cl.
*E21B 34/06* (2006.01)

(52) U.S. Cl.
USPC ..... 166/332.1; 166/334.4

(58) Field of Classification Search
CPC ..... E21B 34/06; E21B 34/14
USPC ..... 166/332.1, 332.4, 334.4
See application file for complete search history.

(56) References Cited

U.S. PATENT DOCUMENTS

| | | | | |
|---|---|---|---|---|
| 3,811,500 | A * | 5/1974 | Morrisett et al. | 166/154 |
| 4,246,968 | A | 1/1981 | Jessup et al. | |
| 5,479,989 | A | 1/1996 | Shy et al. | |
| 7,108,067 | B2 | 9/2006 | Themig et al. | |
| 7,743,647 | B1 | 6/2010 | Israel et al. | |
| 7,870,907 | B2 | 1/2011 | Lembcke et al. | |
| 2002/0014354 | A1 * | 2/2002 | Patterson | 175/57 |
| 2010/0084146 | A1 | 4/2010 | Roberts | |
| 2010/0108323 | A1 | 5/2010 | Wilkin | |
| 2010/0166665 | A1 * | 7/2010 | Butts et al. | 424/9.32 |
| 2012/0247767 | A1 * | 10/2012 | Themig et al. | 166/289 |

* cited by examiner

*Primary Examiner* — William P Neuder
(74) *Attorney, Agent, or Firm* — Steve Rosenblatt

(57) ABSTRACT

A sliding sleeve device features a first sleeve that can be shifted with a dropped object on a seat and applied pressure to open a housing port. A second sleeve is in line with the first sleeve and be shifted to straddle the housing ports that we exposed when the opening sleeve was shifted initially. Snap rings or other locking devices can be used to hold the closing sleeve in the shifted position with the housing ports closed. The closing sleeve can also be shifted with a shifting tool that is run for example on coiled tubing. The opening sleeve can also optionally be shifted with a tool in an uphole direction to open the housing ports.

14 Claims, 1 Drawing Sheet

DUAL INLINE SLIDING SLEEVE VALVE

FIELD OF THE INVENTION

The field of the invention is sliding sleeve valves and more particularly of the type that align separate sleeves for opening ports and closing ports.

BACKGROUND OF THE INVENTION

Sliding sleeve valves are typically shifted down to open ports such as by dropping an object like a ball or plug onto a seat and pressuring up as illustrated in U.S. Pat. Nos. 7,743,647 and 7,108,067. In some designs the same sleeve is shifted once to open ports with the sleeve coming against a shearable travel stop. To close the sleeve another plug is dropped to contact the same sleeve and break the shearable travel stop to move the same sleeve further in the same direction as when the ports opened to again close the ports. This design is illustrated in U.S. Pat. No. 4,246,968. Yet other designs place two sleeves in a concentric alignment and shift the first sleeve 44 to open ports and the second sleeve 46 to close the ports in a housing as illustrated in US Publication 2010/0166665. Other designs combine a ball drop to open the ports with a sleeve and an independent hydraulic system to move the sleeve to close the ports using a complex dual bore structure as in US Publication 2010/0084146. Shifting tools have been designed to move the same sleeve in opposed directions for opening and closing ports as described in US Publication 2010/0108323. Of general interest is a protective sheath that is removable once the sliding sleeve is moved to the open position as described in U.S. Pat. No. 7,870,907 and a sleeve with a collet system for location purposes as described in U.S. Pat. No. 5,479,989.

There are several problems with the above designs. Placing multiple sleeves in a concentric alignment reduces the drift dimension and requires elaborate sealing systems between sleeves. Another problem with concentric sleeves or sleeves that are to be shifted in an opposed direction to close ports is that such motion to close may be made impossible by the nature of the wear adjacent either a port in the sleeve, if used, or the port in the housing through which erosion can take a toll by providing housing or sleeve segments that stick out and snag when trying to shift either a second concentric sleeve or even a single sleeve in an opposed direction to close ports after they have been in service for a period of time.

The present invention provides a low cost option that can operate reliably to open ports and then to close them. Two sleeves are used that operate independently. The opening sleeve can be pushed with an object such as a ball landing on a seat to either align ports in the sleeve and the housing or to move the sleeve clear of a housing port. When it is time to close the housing ports another sleeve that is aligned with the first sleeve but has been in a generally protected position with regard to the erosive stream is then deployed either with a shifting tool or another dropped object to close the housing ports. The closing sleeve is preferably uphole from the opening sleeve but can also be located below the opening sleeve. These and other aspects of the present invention will be more readily understood by those skilled in the art from a review of the detailed description and the associated figure while understanding that the full scope of the invention is to be found in the appended claims.

SUMMARY OF THE INVENTION

A sliding sleeve device features a first sleeve that can be shifted with a dropped object on a seat and applied pressure to open a housing port. A second sleeve is in line with the first sleeve and be shifted to straddle the housing ports that we exposed when the opening sleeve was shifted initially. Snap rings or other locking devices can be used to hold the closing sleeve in the shifted position with the housing ports closed. The closing sleeve can also be shifted with a shifting tool that is run for example on coiled tubing. The opening sleeve can also optionally be shifted with a tool in an uphole direction to open the housing ports.

DETAILED DESCRIPTION OF THE PREFERRED EMBODIMENT

Figure 1:
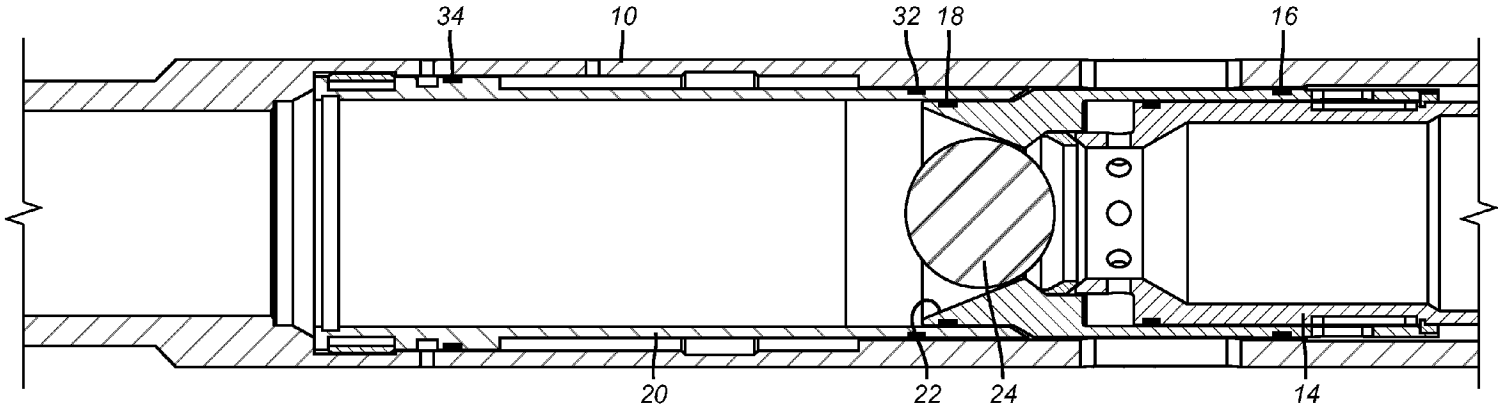
FIG. 1 is a section view at run in with the housing ports closed and the sleeve in contact with each other.

Referring to FIG. 1 a housing 10 has a series of ports 12 that in the preferred embodiment are shown as a single row of slots with rounded ends. Other opening shapes and multiple rows can be used to gain the desired flow area for the anticipated flow rates while leaving sufficient wall between the openings to ensure that the housing is structurally up to the task of resisting the expected pressure differential across the ports at the anticipated flow conditions. An opening sleeve 14 is in the closed position in FIG. 1 where its seals 16 and 18 straddle the ports 12. It should be noted that seal 18 initially is against the closing sleeve 20 but as an alternate can be against the housing 10. In the latter case for run in the sleeves 14 and 20 will not be touching for the run in position of FIG. 1. However, putting the sleeves 14 and 20 together serves to better protect the housing wall of the housing 10 which would otherwise be exposed to slurry flow once the sleeve 14 was shifted open and slurry flow began.

Figure 2:
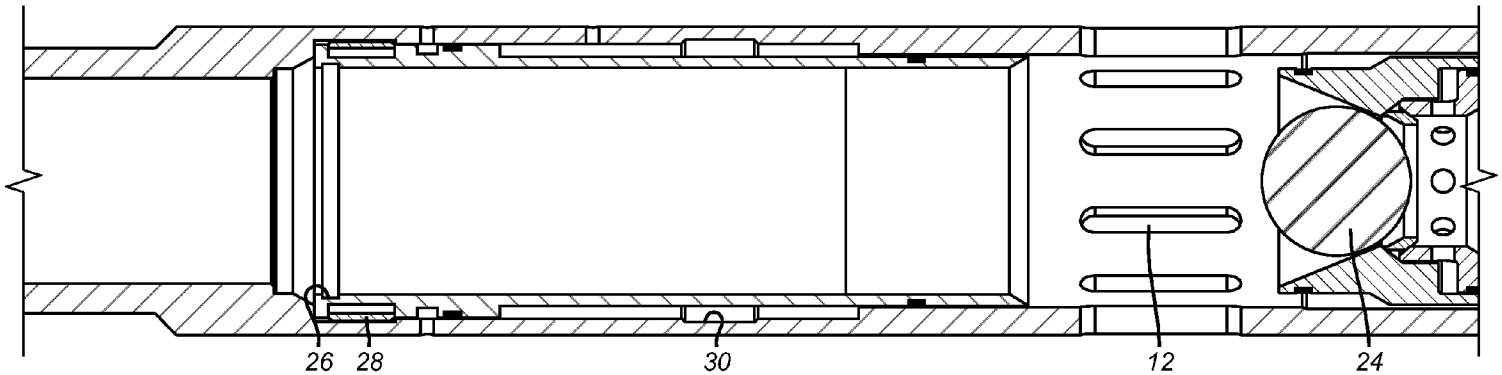
FIG. 2 is the view of FIG. 1 with the opening sleeve shifted to open the housing ports and the closing sleeve in position to be moved down to close the housing ports and latch in the closed position.

Sleeve 14 has a tapered component 22 that can act a ball seat for ball or an object of another shape 24 that can land on seat 22 and allow built up pressure from a surface location to provide the differential pressure to shift sleeve 14 to the FIG. 2 position to expose the housing ports 12 for procedures such as fracturing, jetting, injection, acidizing or production to name a few possibilities.

FIG. 2 shows the opening sleeve 14 shifted using pressure on ball 24 so that the ports 12 are now open and the desired procedure can take place. At the conclusion of that procedure or for example in production mode when it is desired to close the ports 12 because a zone is producing water or sand a profile 26 can be engaged with a shifting tool that is not shown to move the sleeve 20 over the ports 12 so that a snap ring such as 28 can expand outwardly into a surrounding groove 30 to lock the closed position of the sleeve 20. The locked closed position of sleeve 20 can coincide with sleeve 20 abutting sleeve 14 or alternatively the two need not touch when the locked closed position for sleeve 20 is obtained.

The closing sleeve could also be shifted with another ball dropped on a seat provided on the sleeve 20 that is not shown. In many applications there are numerous zones in a well and there can be a difficulty in having enough ball sizes for all the ball seats in a specific completion. Accordingly shifting the closing sleeve 20 with a shifting tool such as one run on wireline or coiled tubing for example is preferred. The two sleeves are aligned so that the drift diameter is not reduced. The closing sleeve 20 has abrasive flow going through it but the flow does not make any turns in so doing so that the wear on sleeve 20 is minimal. Even if there is some enlargement of the openings 12 the sleeve 20 will span over them with seals 32 and 34 straddling the openings 12.

Another alternative is to have opening sleeve 14 shifted mechanically such as by a shifting tool and closing sleeve 20 can be shifted with a dropped ball. In this configuration the sleeve 20 can still be above or further toward the surface than sleeve 14. As another option the arrangements of the sleeves 14 and 20 can be reversed. In that case the sleeve 14 would be shifted toward the surface with a shifting tool to expose the ports 12. The closing sleeve would also then be shifted in the same direction with the shifting tool to close the ports 12. The advantage here would be that the closing sleeve is out of the abrasive flow path of the now open ports 12 and sees less erosive wear. To do this the other sleeves further downhole would need to be closed to properly direct the fracturing fluid out of the desired ports 12. Using the dropped ball 24 to move the opening sleeve offers the advantage of not using a shifting tool to move sleeve 14 and allowing the use of the seated ball 24 to isolate the remaining sleeves through which the frac fluid has already been delivered as the process moves in an uphole direction. Using shifting tools allows more flexibility with the order that various port 12 locations are opened so that the fracturing or other procedure can take place in an uphole or downhole or a random order, if desired.

Other means of actuating the sleeves are envisioned such as pistons actuated by control lines or tubing or annulus pressure or locally mounted motor drivers. The stacking of the sleeves preserves the drift diameter and enhances the operability of the assembly while reducing the manufacturing cost and improving reliability of operation.

The above description is illustrative of the preferred embodiment and many modifications may be made by those skilled in the art without departing from the invention whose scope is to be determined from the literal and equivalent scope of the claims below:

We claim:

1. A sliding sleeve valve for subterranean use, comprising:

a plurality of axially stacked sleeves in a passage in a housing, said housing having at least one wall opening for selectively opening and closing said opening with different said sleeves;

said sleeves comprise an opening sleeve and a closing sleeve, said closing sleeve is axially misaligned from said wall opening when said opening sleeve is moved to allow flow through said opening.

2. The valve of claim 1, wherein:

said opening sleeve further comprises a seat to accept an object to close said passage so that pressure on the object shifts said opening sleeve to open said opening.

3. The valve of claim 1, wherein:

said sleeves are spaced apart for run in.

4. The valve of claim 1, wherein:

said sleeves abut for run in.

5. The valve of claim 1, wherein:

said sleeves move in the same direction for opening and then closing said port.

6. The valve of claim 1, wherein:

said opening sleeve is located below said closing sleeve.

7. The valve of claim 1, wherein:

one of said sleeves is an opening sleeve and is located above another of said sleeves that is a closing sleeve.

8. The valve of claim 6, wherein:

said closing sleeve closing said wall opening.

9. The valve of claim 6, wherein:

said opening and closing sleeves further comprise spaced seals that engage said housing to straddle said port when either of said sleeves are located over said port.

10. The valve of claim 4, wherein:

said sleeves overlap axially for run in.

11. The valve of claim 10, wherein:

one of said sleeves is an opening sleeve and is located below another of said sleeves that is a closing sleeve;

said opening sleeve comprises spaced seals to straddle said opening when said opening sleeve is located over said opening to close said port with one seal contacting said housing and another contacting another said sleeve which is a closing sleeve.

12. The valve of claim 1, wherein:

said at least one opening comprises a plurality of openings in at least one single row.

13. The valve of claim 12, wherein:

said openings comprise elongated openings with rounded ends.

14. The valve of claim 8, wherein:

said closing sleeve locks after closing said wall opening.

* * * * *